US009950774B2

(12) United States Patent
Brinkel et al.

(10) Patent No.: US 9,950,774 B2
(45) Date of Patent: Apr. 24, 2018

(54) TWIN-HULL OFFSHORE STRUCTURE COMPRISING AN INTERCONNECTING CENTRAL DECK

(71) Applicant: SBM SCHIEDAM B.V., Schiedam (NL)

(72) Inventors: Theodorus Johannes Bernardus Brinkel, Rijswijk (NL); Willem Cornelis Van Wijngaarden, Gorinchem (NL)

(73) Assignee: SINGLE BUOY MOORINGS INC., Marly (CH)

( * ) Notice: Subject to any disclaimer, the term of this patent is extended or adjusted under 35 U.S.C. 154(b) by 0 days.

(21) Appl. No.: 15/021,958

(22) PCT Filed: Sep. 18, 2014

(86) PCT No.: PCT/NL2014/050640
§ 371 (c)(1),
(2) Date: Mar. 15, 2016

(87) PCT Pub. No.: WO2015/041526
PCT Pub. Date: Mar. 26, 2015

(65) Prior Publication Data

US 2016/0221647 A1 Aug. 4, 2016

(30) Foreign Application Priority Data

Sep. 18, 2013 (EP) ..... 13184955

(51) Int. Cl.
*B63B 35/44* (2006.01)
*B63B 1/12* (2006.01)
(Continued)

(52) U.S. Cl.
CPC ..... *B63B 35/44* (2013.01); *B63B 1/121* (2013.01); *B63B 1/125* (2013.01); *B63B 9/065* (2013.01);
(Continued)

(58) Field of Classification Search
USPC ..... 405/195.1, 203–205; 114/264, 265; 441/3–5
See application file for complete search history.

(56) References Cited

U.S. PATENT DOCUMENTS 3,217,681 A * 11/1965 Thornton ..... B63B 35/4413 114/265
3,323,478 A 6/1967 Hunsucker
(Continued)

FOREIGN PATENT DOCUMENTS

DE 3920334 1/1991

OTHER PUBLICATIONS

International Search Report PCT/NL2014/050640 dated Dec. 9, 2014.

*Primary Examiner* — Sean D Andrish
(74) *Attorney, Agent, or Firm* — Young & Thompson

(57) ABSTRACT

A floating hydrocarbon processing/storage structure with a first and second assembly, each including a hull having side walls, one or more storage tanks and a deck structure, a connection structure interconnecting the hulls, processing equipment situated on the deck structures, at least one riser connected to a subsea hydrocarbon well and to the processing equipment and/or storage tanks, with a mooring system connecting the processing/storage structure to the sea bed, each hull including a hull deck structure bridging the side walls, the connection structure including a central deck extending at or near the height of the hull deck structures along at least 70% of the length of the hulls, the central deck
(Continued)

supporting at least one of: risers vertically extending from the central deck between the hulls to the sea bed, fluid ducts horizontally supported on the central deck, and at least one drilling/work-over rig or crane.

17 Claims, 13 Drawing Sheets

(51) Int. Cl.

| | |
|---|---|
| ***B63B 9/06*** | (2006.01) |
| ***B63B 21/50*** | (2006.01) |
| ***E21B 19/00*** | (2006.01) |
| ***B63B 25/08*** | (2006.01) |
| *B63B 1/06* | (2006.01) |
| *B63B 9/04* | (2006.01) |
| *B63B 25/12* | (2006.01) |
| *B63B 25/16* | (2006.01) |

(52) U.S. Cl.
CPC ..... *B63B 21/507* (2013.01); *B63B 25/08* (2013.01); *E21B 19/004* (2013.01); *B63B 1/06* (2013.01); *B63B 9/04* (2013.01); *B63B 25/12* (2013.01); *B63B 25/16* (2013.01); *B63B 2035/448* (2013.01)

(56) References Cited

U.S. PATENT DOCUMENTS

| | | | | |
|---|---|---|---|---|
| 3,919,960 | A | 11/1975 | Amoss, Jr. | |
| 6,546,739 | B2 * | 4/2003 | Frimm | B63B 27/24 62/240 |
| 7,101,118 | B2 * | 9/2006 | Brinkel | B63B 1/121 114/264 |

* cited by examiner

TWIN-HULL OFFSHORE STRUCTURE COMPRISING AN INTERCONNECTING CENTRAL DECK

FIELD OF THE INVENTION

The invention relates to floating hydrocarbon processing and storage structure with a first and a second assembly each comprising a hull having spaced-apart side walls, one or more storage tanks and a deck structure, a connection structure interconnecting the first and second hulls, processing equipment being situated on the hull deck structures, at least one hydrocarbon riser connected to a subsea hydrocarbon well and to the processing equipment and/or to the storage tanks, and with a mooring system connecting the hydrocarbon processing and storage structure to the sea bed.

The invention also relates to a method of constructing such a hydrocarbon processing and storage structure.

BACKGROUND OF THE INVENTION

In the offshore industry, Floating Production Storage and Offloading (FPSO's) vessels have in the past years continuously increased in size and complexity. Topsides are provided with oil and/or gas processing equipment that includes steam turbine electrical generators, condensate export pumps, oil cracking installations, distillation equipment, heat exchangers, gas to liquid (GTL) plants, LNG, LPG or mixed hydrocarbon production, liquefaction and processing equipment. The last three generations of FPSO's have seen an increase in topside weight from 1000 tons to over 20,000 tons. These heavy and high topsides have a negative effect on the vessel's stability while deck space is limited in view of the dense layout of the equipment placed on deck. Also storage capacity within the hull reaches its limits.

In U.S. Pat. No. 7,101,118 a twin-hull construction is shown in which two hulls are interconnected via bracings, and a single wide deck structure is fitted across the hulls, processing equipment or a fuel powered power generator being placed on the deck structure. Hydrocarbons can be stored in tanks, which may comprise cryogenic LNG tanks, in either hull prior to offloading via shuttle tankers, before and after processing. The hulls may be converted oil or LNG tankers, with their storage tanks for hydrocarbons situated completely within the hulls or partly extending above deck level such as in case of spherical LNG tanks. A turret, moored to the sea bed is placed between the hulls.

In DE 27 07 628 a twin-hull vessel is described constructed from two existing hulls that are interconnected via a bracing structure, and a single external hull surrounding the existing hulls. Personnel quarters, LNG liquefaction equipment, transfer means and a flare tower are provided on the deck. A single point mooring arrangement, moored to the sea bed and carrying a production riser is placed in the forward deck structure.

The above multi hull structures have increased weight carrying capacity and can accommodate large and complex process installations such as GTL, LPG, LNG or a mix of hydrocarbon related processes. The twin hull structures have improved stability and provide a relatively large storage capacity. Furthermore, they can be used in combination with large size turrets, increasing the area of application. Also, they are able to operate at lower drafts to provide a high freeboard and allow dry tree usage.

The above known multi hull vessels have as a disadvantage that a wide overlying deck structure is placed over both interconnected hulls onto which overlying deck structure the processing equipment is later mounted. The large overlying deck is formed by a heavy and complex steel structure. This requires a large construction site for accommodating the combined hulls during mounting of the processing equipment, involving expensive and large sized dry-docks.

It is hence an object of the present invention to provide a multi hull vessel of increased storage capacity and weight carrying capacity, allowing installation of process equipment for oil production, gas treating, gas liquefaction, oil refining, oil cracking, gas to liquid conversion and other hydrocarbon processes. It is a further object to provide a floating structure carrying processing equipment on the deck structure, which can be constructed easily and in a cost effective manner.

SUMMARY OF THE INVENTION

Hereto a vessel according to the present invention is characterized in that each hull comprises a respective hull deck structure bridging the side walls,

- the interconnection structure comprises a central deck extending at or near the height of the hull deck structures along at least along 70% of the length of the hulls, the central deck supporting one of the following features or a combination thereof:
- a number of risers vertically extending from the central deck between the hulls to the sea bed, along at least for one third of the length of the central deck, preferably along half of its length,
- a number of fluid ducts (31) horizontally supported on the central deck along at least for one third of the length of the central deck, preferably along half of its length, and
- at least one drilling or work-over rig or crane.

By constructing the first and second assemblies of hull and deck, and subsequently interconnecting both hull-deck assemblies via the connection structure which may comprise intermediate beams, intermediate decks, trusses, bulkheads, beams at mid-ship positions and near the bottom, and the like, a large part of the hydrocarbon processing equipment can be placed on each respective deck prior to interconnection, in conventional construction facilities that are tailored to the width of a single assembly of hull and deck, which may be formed by known FPSO's, floating storage and regasification units (FSRU's), hydrocarbon carriers and the like. After interconnecting both hull-deck assemblies via the connection structure of the vessel according to the invention and providing a central deck, this central deck can be utilised for supporting vertical risers at an offshore site. Alternatively, the central deck is used for carrying a number of hydrocarbon ducts extending lengthwise across the deck structure. The ducts may be accommodated in a pipe rack assembly. In another embodiment, the central deck is used for the installation of one or more cranes that may be stationary on the central deck structure or that may be mobile along the central deck structure. A drilling or work-over rig may also be accommodated on the central deck. In this case, pipe segments forming the drill string may be accommodated on the central deck in a pipe rack construction.

By means of the present invention, construction time and costs can be reduced as construction is no longer limited to the use of a small number of ultra large docks over a relatively long period of time, but can involve smaller docks used to first finalize the separate hulls including the topside facilities. After completion of the individual assemblies of hull, deck structure and topside facilities, which could be carried out in different sites, only a short dry-docking period is required to connect the two assemblies together.

Alternatively, mounting of the interconnection structure may be done in-water. Hereby the use of a large and expensive dry-dock in no longer required and interconnection of the assemblies is possible at nearly any construction site.

An embodiment of a floating hydrocarbon processing and storage structure according to the invention comprises between the hulls an intermediate bottom hull part, a bow hull part and an aft hull part and at least one fluid storage tank comprised within the space between the two hull parts underlying the central deck. The interconnected hull-deck assemblies can be formed into an enclosed space by the additional hull parts, such that a dry space is formed in which fluids such as water, hydrocarbons such as condensate, or other liquids may be stored. The bow hull part will improve the structure's sailing characteristics and may be used for storage or accommodating marine systems or machinery.

The central deck may have a width of between 0.2 and 0.5 times the width of the respective hulls. This provides sufficient space while maintaining the rigidity of the interconnected hull-deck assemblies. The central deck may comprise stiffened plating supported by deep girders as used for known ship deck structures. Transverse bulkheads are formed in the interconnection structure to provide sufficient transverse strength and at the same time create separated tanks and storage spaces.

In another embodiment, at least one hull is provided along its outer wall with an outboard riser supporting structure, supporting a number of risers. The risers may be accommodated by supporting them from one or two riser balconies situated alongside each hull. Each riser balcony may for instance have a length of 130 m (at a vessel length of approximately 320 m) and may support for instance 55 risers. The number of risers in a single hull vessel is limited due to the hull shape and the spread moored anchoring system. By utilising the central deck in a twin-hull configuration, not only additional risers can be accommodated in the central deck space (for instance two rows of 55 risers or more) but the number of risers in both riser balconies can be increased, for instance to 75 risers in each riser balcony. In combination with risers depending from the central deck and extending downward between the interconnected hulls, this provides for large numbers, such as over 200, of risers to be utilised.

In one embodiment, the central deck supports a number of risers vertically extending from the central deck between the hulls to the sea bed, along at least for one third of the length of the central deck, preferably along half of its length, and/or a number or risers and/or pipe elements horizontally supported on the central deck along at least for one third of the length of the central deck, preferably along half of its length, the structure comprising a track along the outer side of each hull, movable supports displaceable along each track, a lifting member extending between the supports and being displaceable over the central area, for lifting of the risers and/or pipe elements. The lifting member can be a gantry crane that can be rolled along the tracks that are provided on the outward side of each hull, for handling of the riser segments during interconnection and lowering. A drilling or work over rig may be placed on the central deck structure to lower the assembled pipe elements in the central space between the hulls to assemble a drill string or for the installation of riser pipes.

In a further embodiment, the mooring system comprises a turret carrying the risers, and connected mooring lines that are moored to the sea bed, the connection structure comprising a bow deck structure rotatably connected to the turret and connected to the hull deck structures and to the central deck at or near the height of said hull deck structures. The turret is rotatable connected to the bow deck structure via an number of axial and radial bearings and can be formed with the bow deck structure as a module that is later attached to the interconnected first and second hull-deck assemblies.

The bow deck structure may be connected to the hull deck structures along the width of the first and second hulls so as to provide a continuous perimeter of the floating structure. A bow structure may extend from the bow deck structure to below the water line, and interconnects the outer side walls of the hull to form a substantially closed bow for improved sea going characteristics.

A method of constructing a floating hydrocarbon processing and storage structure comprises the steps of:

- providing a first and a second assembly each having a hull with spaced-apart side walls, one or more storage tanks and a hull deck structure bridging the side walls,
- interconnecting the assemblies via a connection structure that comprises a central deck extending at or near the height of the hull deck structures substantially along the length of the hulls, providing a bow module having a turret for carrying the risers, and connectors for mooring lines that are moored to the sea bed, and a bow deck structure rotatably connected to the turret and
- connecting the bow module to the hull deck structures and to the central deck structure at or near the height of said deck structures.

In this way a modular construction is obtained in which each of the hull-deck assemblies and bow module can be completed at different sites to be brought together for assembly at the most suitable location.

BRIEF DESCRIPTION OF THE DRAWINGS

Some embodiments of a floating hydrocarbon processing and storage structure according to the invention will by way of example be explained in detail with reference to the accompanying drawings. In the drawings.

DETAILED DESCRIPTION OF THE DRAWINGS

Figure 1:
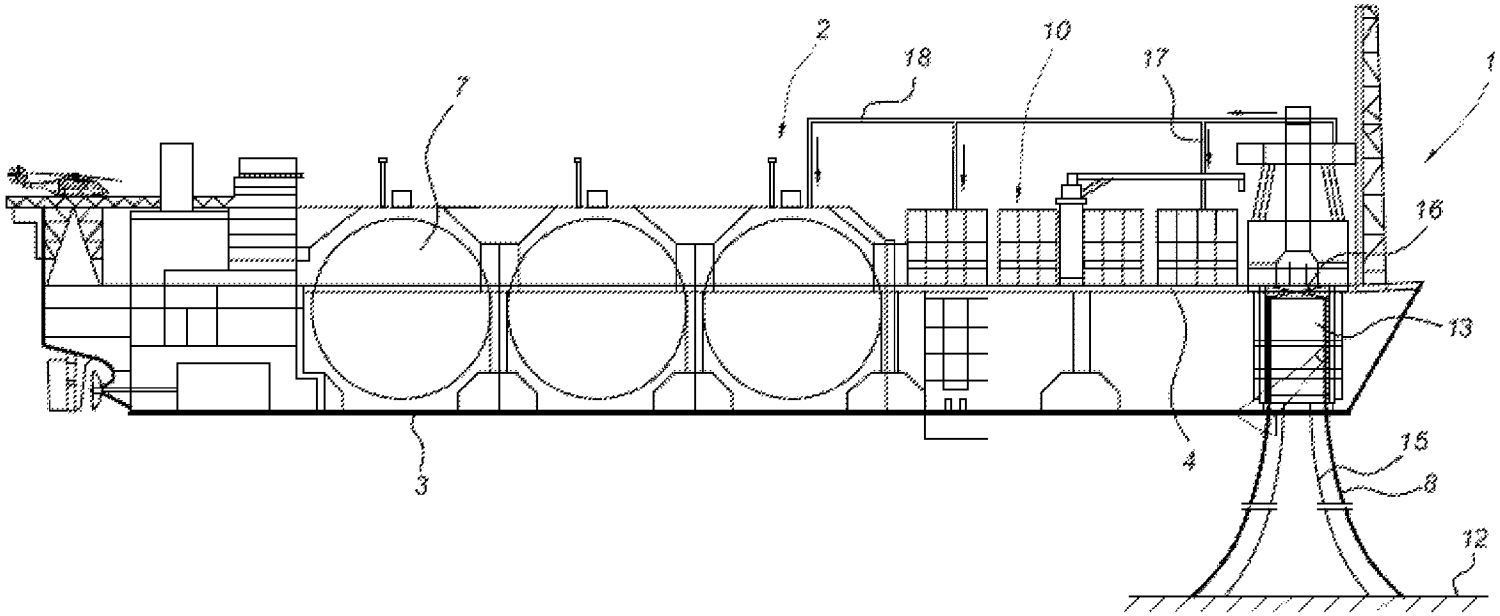
FIG. 1 shows a side view of a floating LNG plant according to the invention.

FIG. 1 shows a floating liquefied natural gas (LNG) plant 1 comprising first and second assemblies 2, 2' each having a hull 3, 3" and a deck structure 4, 4'. The deck structures 4,4' bridge the width W (see FIG. 2) of the hulls, that is defined by side walls 5,6;'5',6. The hulls 3,3' accommodate cryogenic spherical LNG tanks 7,7' that partly extend above deck level. Processing equipment 10,10' such as liquefaction equipment including air compressors, steam turbine electrical generators, a liquefied petroleum gas (LNG) export system, a LPG extraction facility, flare drums and the like is situated on the deck structures 4,4'. The LNG plant 1, which is a vessel, is moored to the sea bed 12 via a mooring system, comprising mooring lines 8 anchored to the sea bed and a turret 13, around which the hulls 3,3' can jointly weathervane. Risers 15 extend from a subsea hydrocarbon well to a swivel 16 on the turret and are at the swivel 16 connected via schematically indicated piping 17, 18 to the processing equipment 10,10' and to the storage tanks 7,7'.

Figure 2:
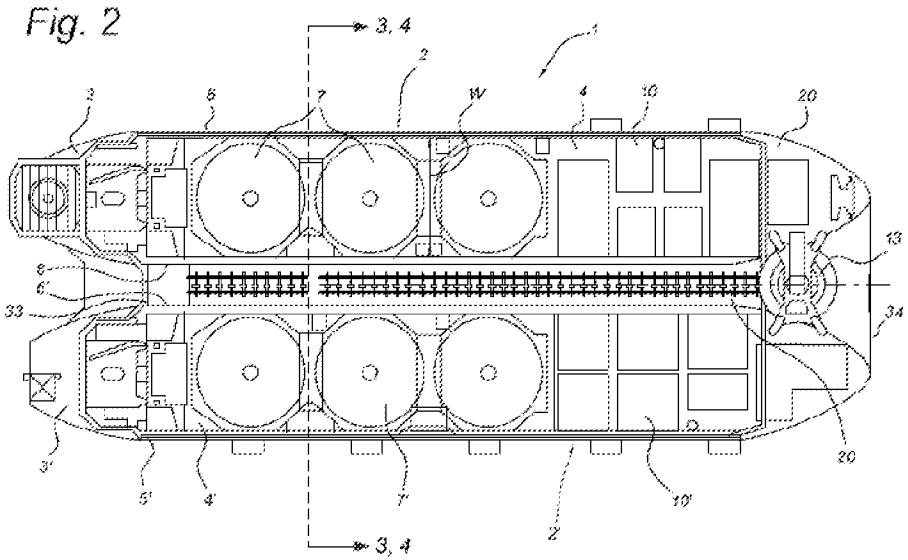
FIG. 2 shows a top view of the floating LNG plant of FIG. 1.

In FIG. 2, the central deck 20 can be seen to extend along at least 70% of the length of the hulls 3,3' at or near the height of the deck structures 4,4'. At the central deck 20, additional processing equipment, vertical risers, horizontal risers or other pipe segments and/or one or more cranes may be supported.

Figure 3:
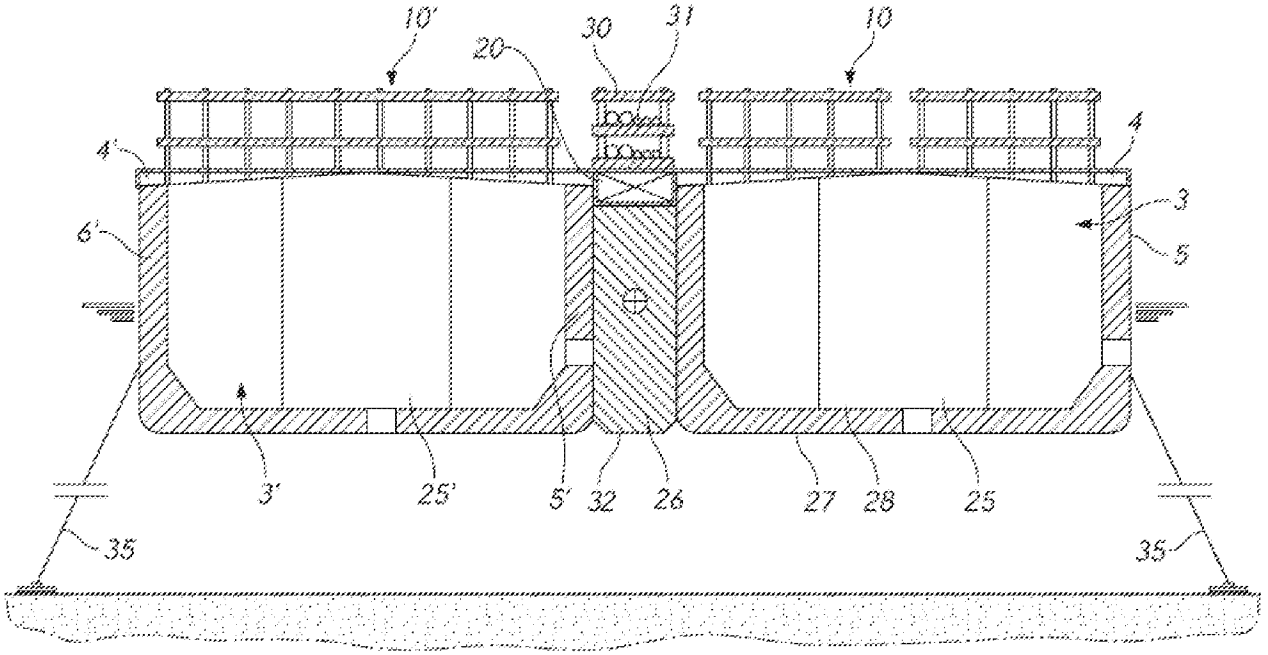
FIG. 3 shows a schematic transverse cross-sectional view of a floating structure according to the invention, along the line III-III in FIG. 2.

In FIG. 3 an embodiment of a twin hull structure is shown comprising hulls 3,3' having double walls 27,28 and the tanks 25, 25', the deck structures 4,4' being supported by bulkheads and by the sidewalls 5,6; 5',6'. A central tank 26 is provided between the hulls 3,3' and is delimited by an intermediate bottom hull part 32, an aft hull part 33 and a bow hull part 34 (see FIG. 2). The hulls 3,3' are moored via a spread mooring configuration 35,35'. On the central deck 20, that extends substantially flush with the deck structures 4,4', a pipe rack 30 is provided, storing pipe segments 31 for forming hydrocarbon transport ducts, the pipe segments extending in the length direction of the twin hulls between various tanks and processing equipment.

Figure 4:
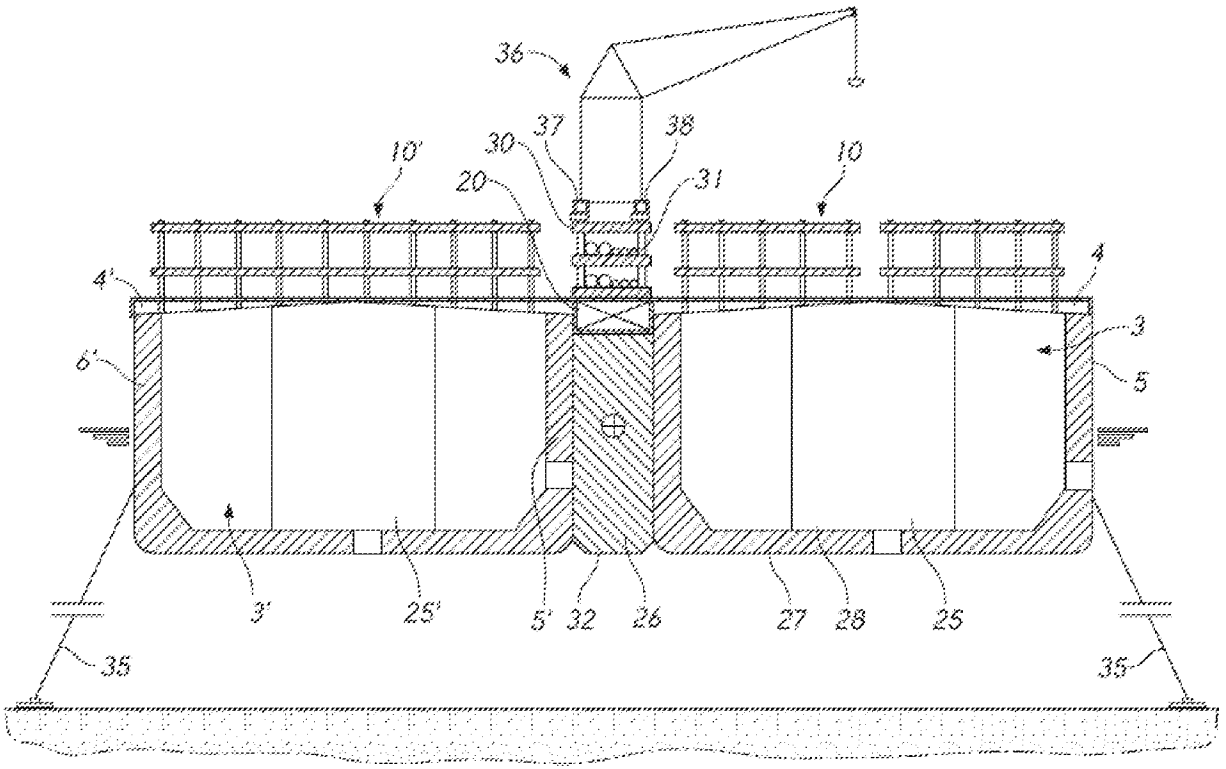
FIG. 4 shows a schematic cross-sectional view of a floating structure of the type shown in FIG. 3 including a traveling crane supported on a central pipe rack.

FIG. 4 shows an alternative embodiment in which a travelling crane 36 is supported via wheels or slide members 37 on tracks 38 running on top of the pipe rack 30 to be displaceable along the central deck 20 in the length direction. In this case, the pipe rack 30 may store pipe segments 31 such as drill string sections or riser pipe sections (steel or flexible), which may be transported via the crane 36 along the tracks 38 to a drilling or work-over rig on the vessel to be interconnected and lowered to the sea bed.

Figure 5:
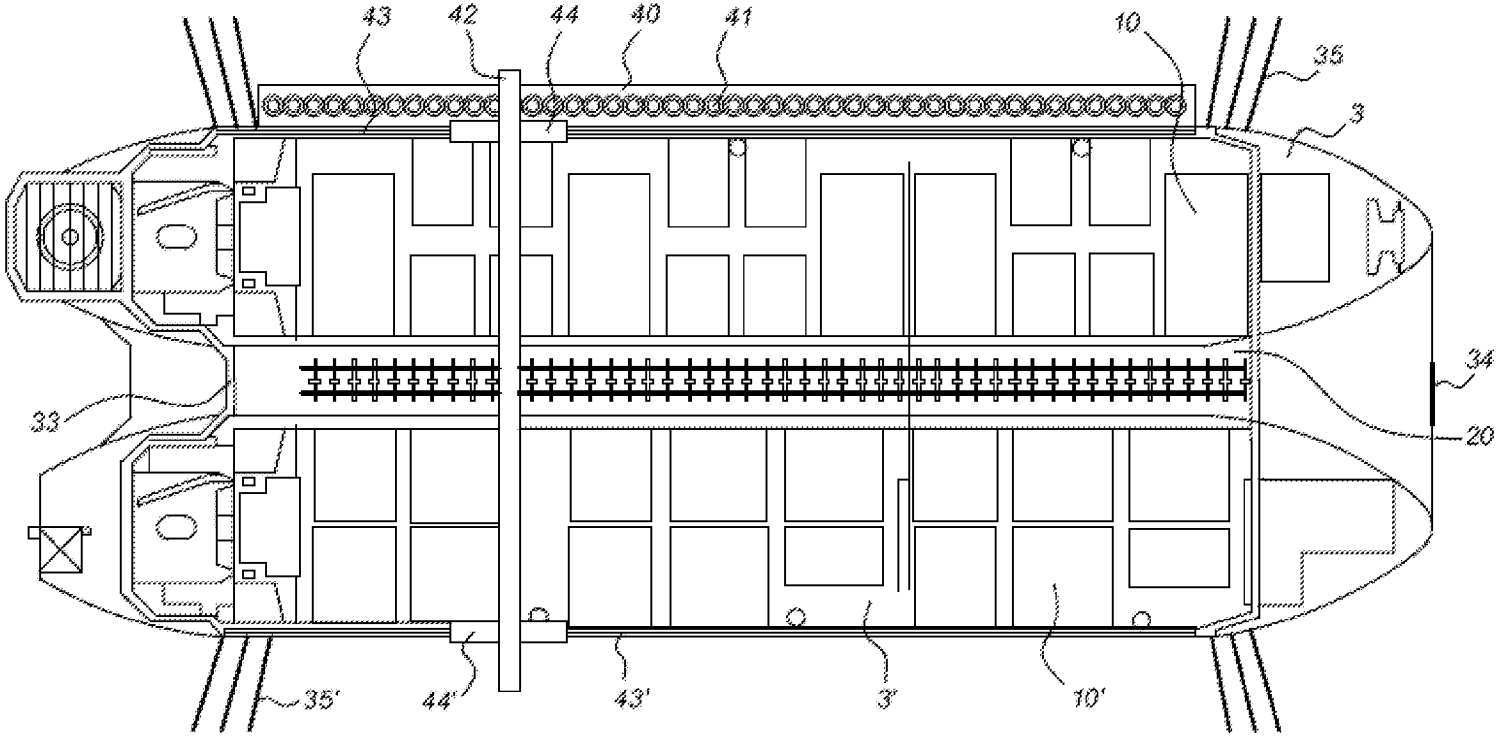
FIG. 5 shows a top view of a spread moored floating structure comprising a riser balcony and a gantry crane.

As shown in FIG. 5, a single gantry crane 42 can be provided with supports 44, 44' movable along tracks 43,43' that extend in the length direction along the outward sides of the hulls 3,3'. A number of risers 41 is pending from a riser balcony 40. Riser segments can be picked up from their horizontal transport position on the central deck 20 by the gantry crane 42 and can be connected in a vertical orientation to the riser parts that are supported from the riser balcony 40 for installation purposes or for increasing hydrocarbon production.

Figure 6:
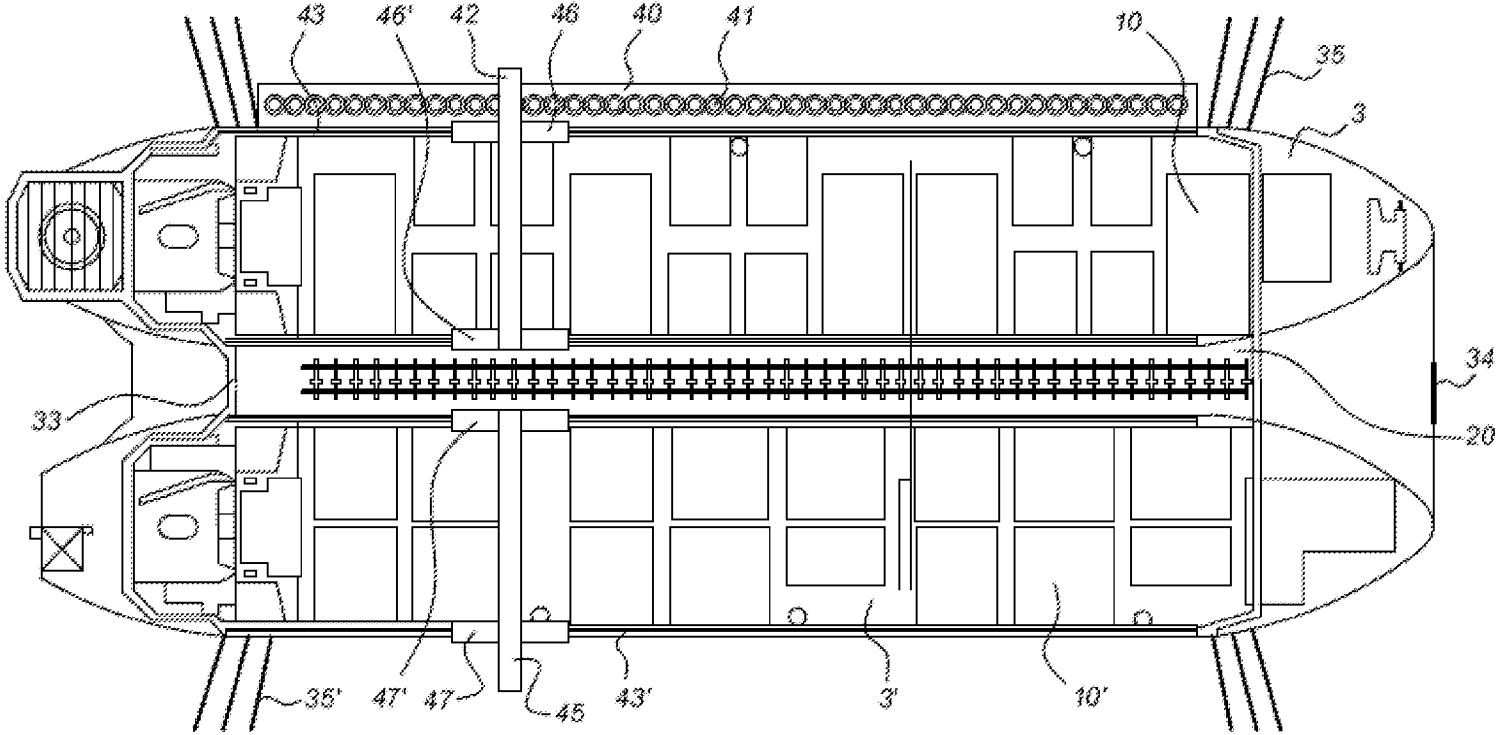
FIG. 6 shows a top view of a structure of the type of FIG. 5 comprising two gantry cranes.

In FIG. 6, two independently movable gantry cranes 42,45 are shown, each spanning the width of a single hull 3, 3'. Gantry crane 42 is mounted on supports 46,46' which run approximately alongside the sidewall positions of hull 3. Gantry crane 45 is mounted on supports 47,47' and can be displaced in the length direction independently from crane 42 for picking up process equipment modules on deck of the vessel during operations or during construction.

Figure 7:
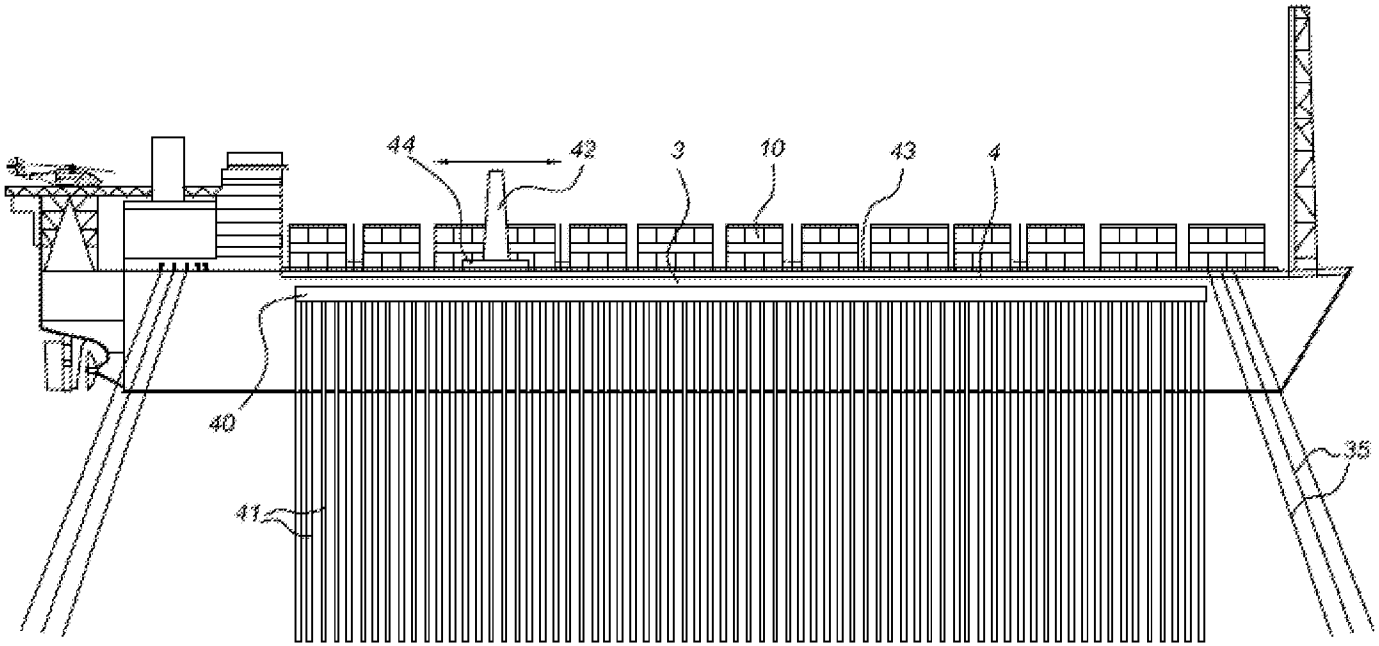
FIG. 7 shows a side view of the floating structure of FIGS. 5 and 6.

FIG. 7 shows the side view of the spread-moored structures of FIGS. 5 and 6.

Figure 8:
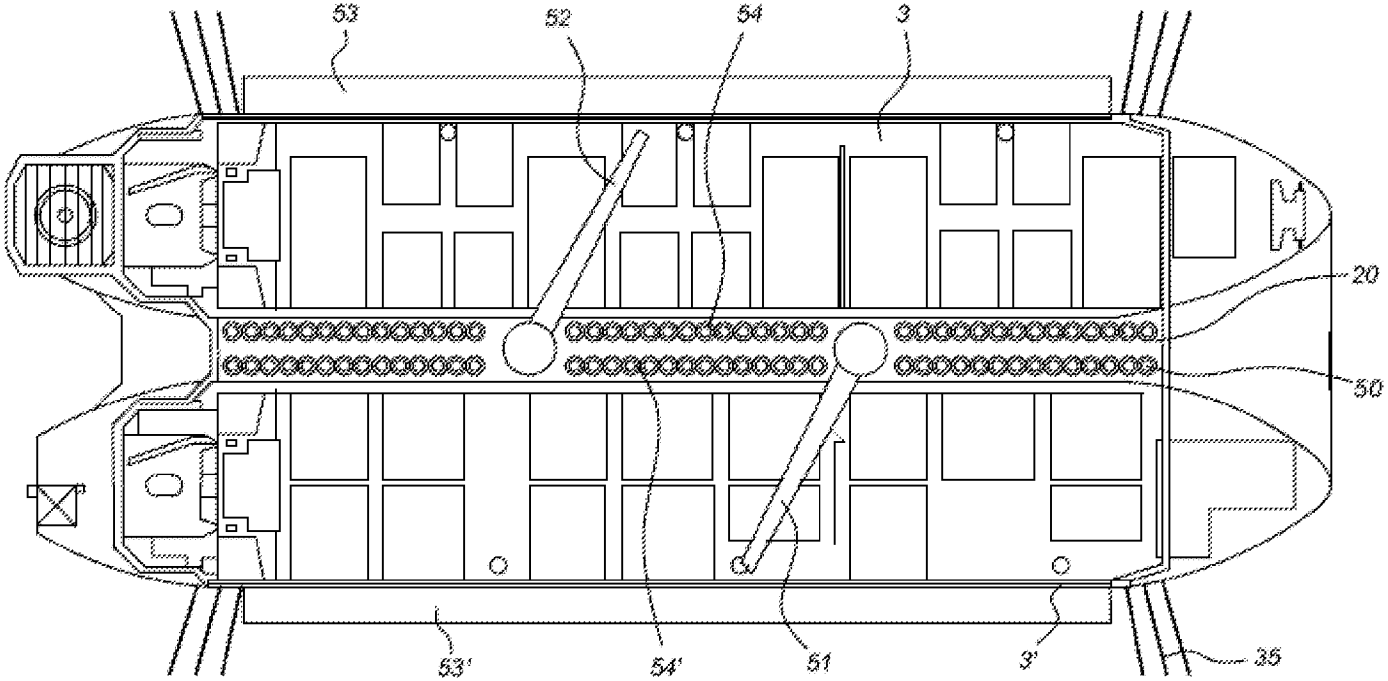
FIG. 8 shows a top view of a spread moored floating structure comprising a central deck, supporting risers and cranes.

In FIG. 8 two fixed rotating cranes 51,52 are provided on the central 5 deck 20, risers 50,54,54' being suspended from the central deck 20. The cranes 51,52 are used for riser installation. The construction in FIG. 8 can optionally be combined with riser balconies 53,53' such that a large number of risers (e.g. 200 risers or more) can be accommodated.

Figure 9:
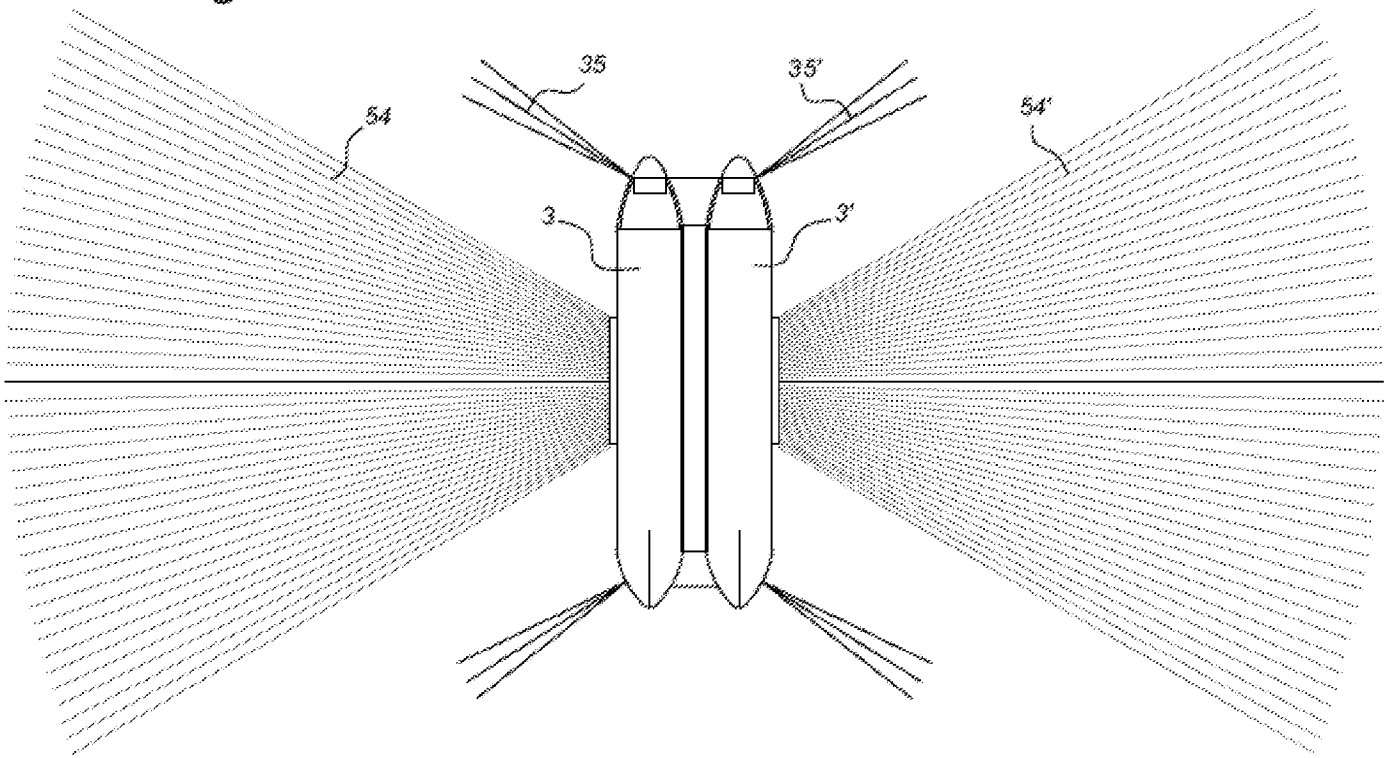
FIG. 9 shows a schematic lay out of the riser configuration of the spread moored structure of FIG. 8.

FIG. 9. shows a top view of the spread of the risers 54, 54' extending from the hulls 3,3' to the sea bed.

Figure 10:
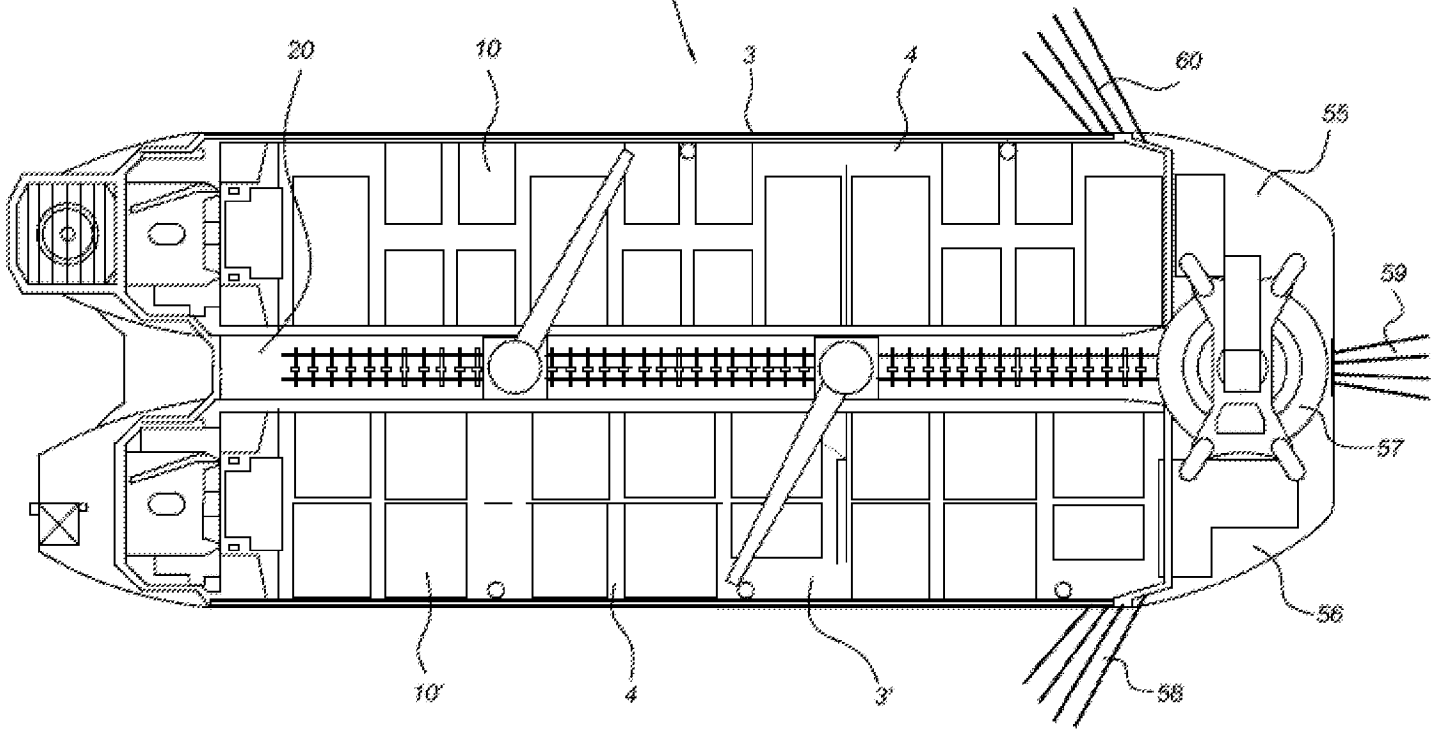
FIG. 10 shows a top view of a floating structure comprising a turret mooring system.
Figure 11:
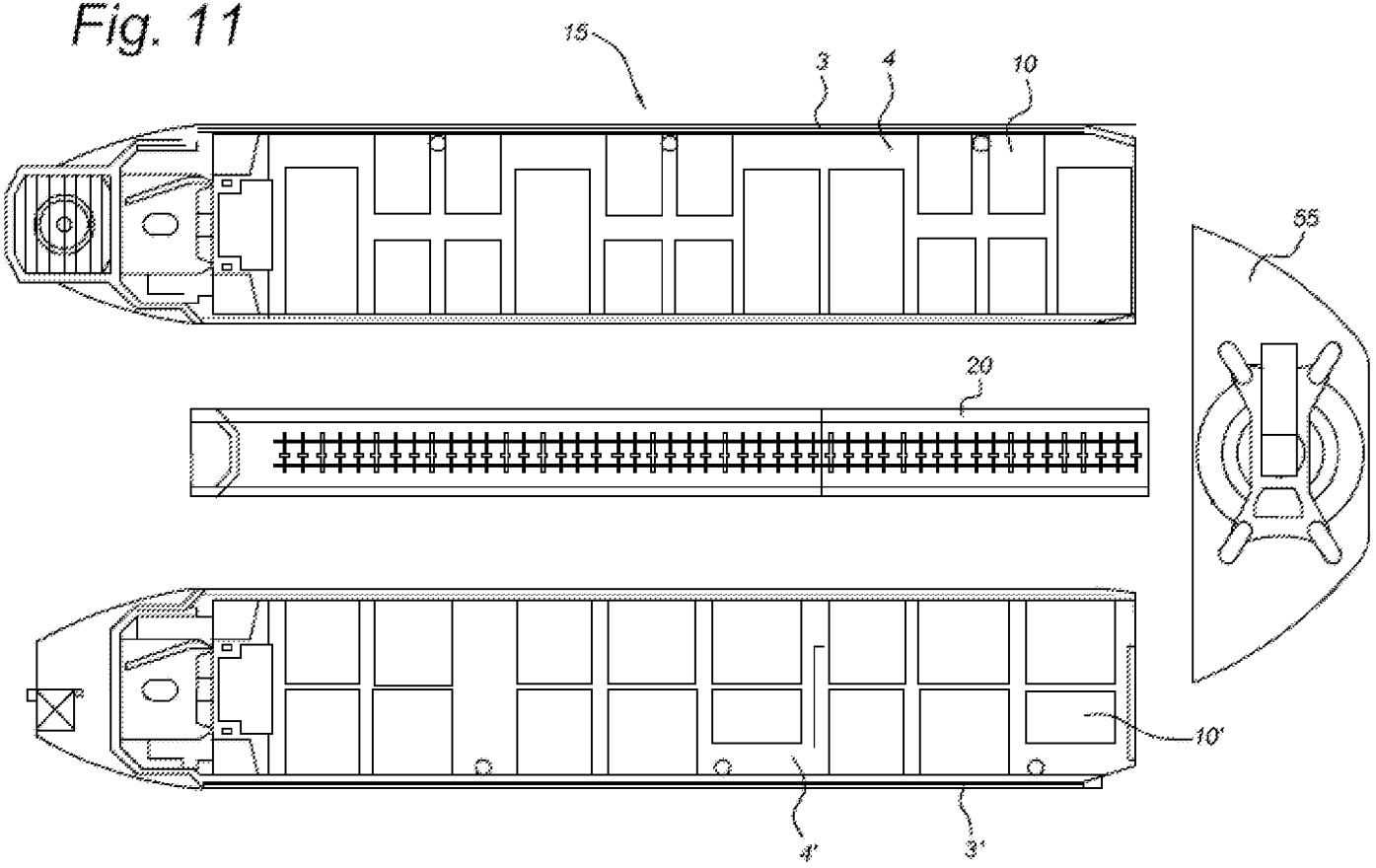
FIG. 11 shows a modular construction of a floating structure according to the invention.

FIG. 10 shows a turret moored vessel 15 in which the hulls 3,3' are connected to a bow module 55 comprising a bow deck structure 56 and a rotatable turret 57 connected to the bow deck structure, which turret is anchored to the sea bed via groups of anchor lines 58, 59, 60. As can be seen from FIG. 11, the vessel 15 is composed of modules comprising hull-deck assemblies 3,4; 3'; 4' supporting respective processing equipment 10, 10', which modules are interconnected via central deck 20 and bow module 55.

Figure 12:
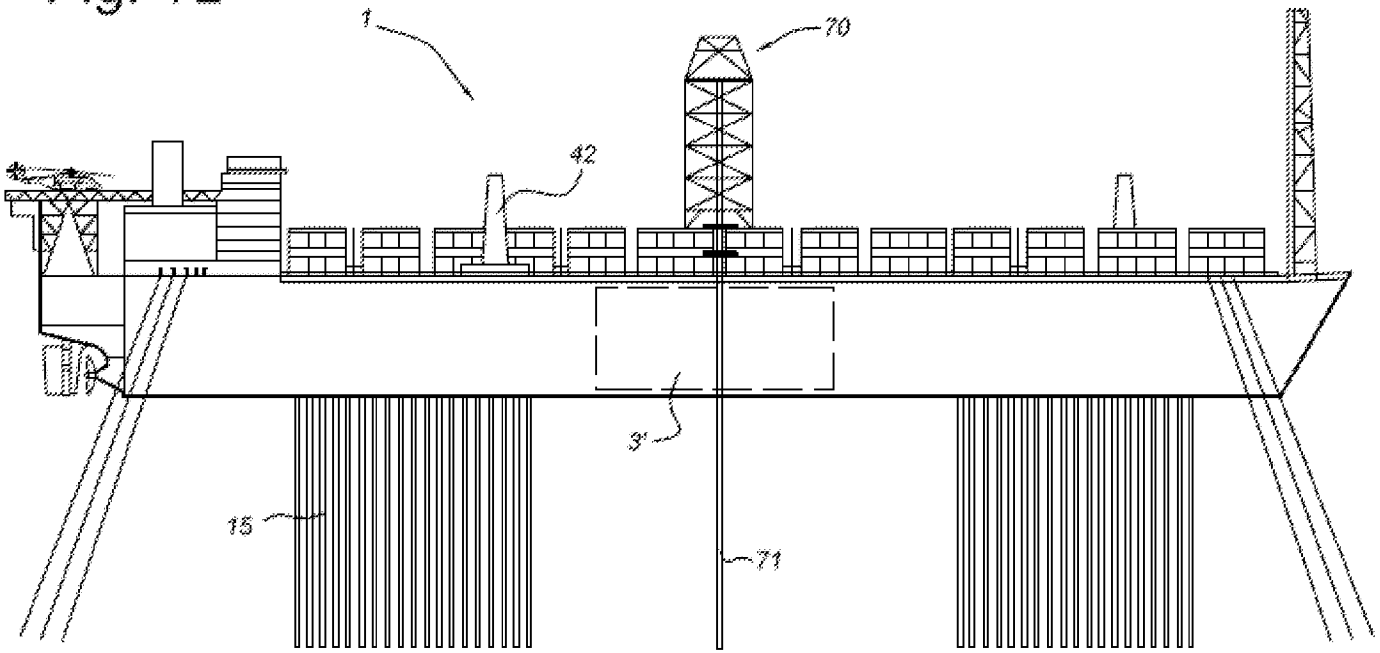
FIG. 12 shows a side view of an embodiment of a floating structure comprising a drilling rig supported on the central deck structure, and FIG. 13. shows a schematic top view of the embodiment of FIG. 13.
Figure 13:
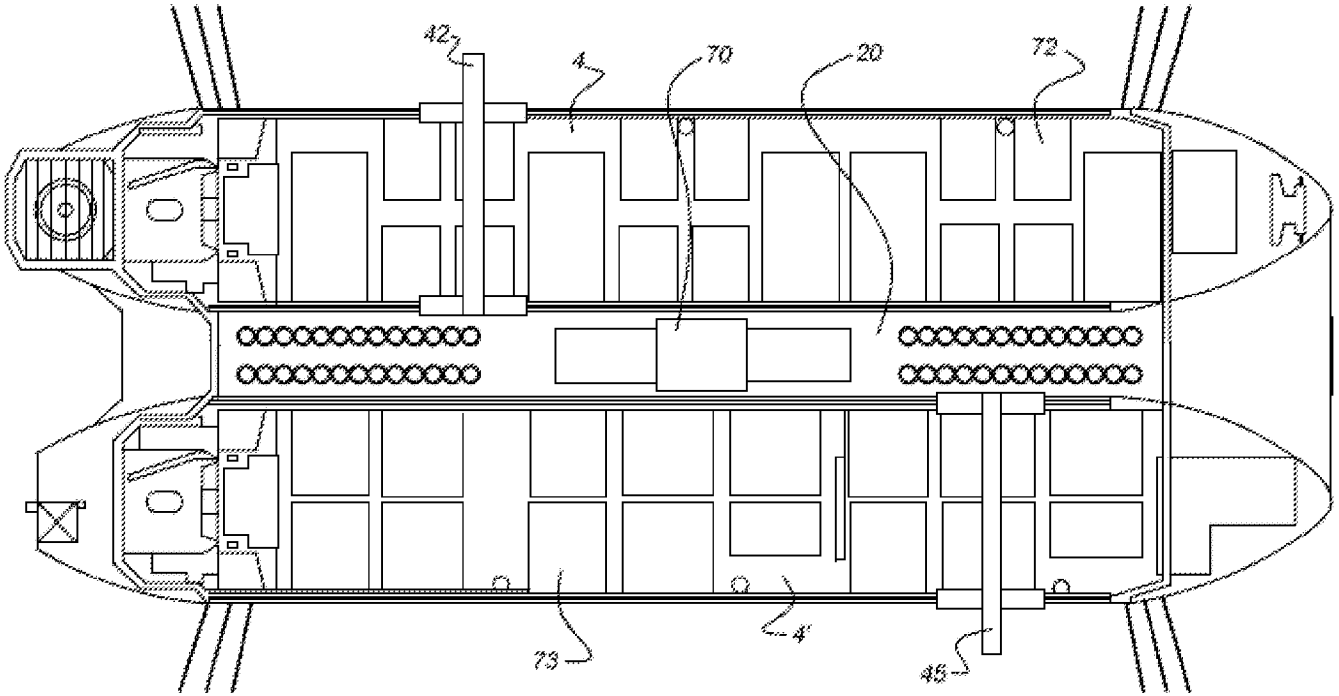

In the embodiment of FIGS. 12 and 13, a drilling or work-over rig 70 is placed on the central deck 20, a drill string or risers 71 being installed via the rig 70. Travelling gantry cranes 42,45 may transport riser parts or pipe sections from a storage position on deck to the rig 70, and may be operated for lifting processing modules or equipment 72, 25 73 on the deck structures 4, 4' of the hulls 3,3'.

The invention claimed is:

1. A floating hydrocarbon processing and storage structure comprising:

a first assembly and a second assembly each comprising a hull having spaced-apart side walls, one or more storage tanks, and a deck structure bridging the side walls;

a connection structure interconnecting the first and second hulls, the connection structure comprising a central deck extending at or near the height of the hull deck structures along at least along 70% of the length of the hulls, processing equipment situated on the deck structures, and at least one hydrocarbon riser extending from the processing equipment or from the storage tanks of the floating hydrocarbon processing and storage structure to a subsea hydrocarbon well; and a mooring system connecting the floating hydrocarbon processing and storage structure to the sea bed;

a track along an outer side of at least one of the hulls and along the central deck;

movable supports displaceable along each track; and a lifting member extending between the supports and being displaceable over the respective deck structure.

2. The floating hydrocarbon processing and storage structure according to claim 1, further comprising:

between the hulls, an intermediate bottom hull part, a bow hull part, an aft hull part, and at least one fluid storage tank comprised within a space between the two hulls underlying the central deck.

3. The floating hydrocarbon processing and storage structure according to claim 2, wherein the central deck has a width between 0.2 and 0.5 of a width W of the hulls.

4. The floating hydrocarbon processing and storage structure according to claim 2, wherein at least one of the hulls is provided along an outer wall thereof with an outboard riser supporting structure, supporting a plurality of risers.

5. The floating hydrocarbon processing and storage structure according to claim 2, wherein the central deck supports one or more of (i) a plurality of risers vertically extending from the central deck between the hulls to the sea bed, along at least one third of the length of the central deck, and (ii) one or more of a plurality of risers and pipe elements horizontally supported on the central deck along at least one third of the length of the central deck.

6. The floating hydrocarbon processing and storage structure according to claim 1, wherein the central deck has a width between 0.2 and 0.5 of a width W of the hulls.

7. The floating hydrocarbon processing and storage structure according to claim 6, wherein at least one of the hulls is provided along an outer wall thereof with an outboard riser supporting structure, supporting a plurality of risers.

8. The floating hydrocarbon processing and storage structure according to claim 6, wherein the central deck supports one or more of (i) a plurality of risers vertically extending from the central deck between the hulls to the sea bed, along at least one third of the length of the central deck, and (ii) one or more of a plurality of risers and pipe elements horizontally supported on the central deck along at least one third of the length of the central deck.

9. The floating hydrocarbon processing and storage structure according to claim 1, wherein at least one of the hulls is provided along an outer wall thereof with an outboard riser supporting structure, supporting a plurality of risers.

10. The floating hydrocarbon processing and storage structure according to claim 9, wherein the central deck supports one or more of (i) a plurality of risers vertically extending from the central deck between the hulls to the sea bed, along at least one third of the length of the central deck, and (ii) one or more of a plurality of risers and pipe elements horizontally supported on the central deck along at least one third of the length of the central deck.

11. The floating hydrocarbon processing and storage structure according to claim 1, wherein the central deck supports one or more of (i) a plurality of risers vertically extending from the central deck between the hulls to the sea bed, along at least one third of the length of the central deck, and (ii) one or more of a plurality of risers and pipe elements horizontally supported on the central deck along at least one third of the length of the central deck.

12. The floating hydrocarbon processing and storage structure according to claim 11, wherein the central deck supports the plurality of risers vertically extending from the central deck between the hulls to the sea bed, along half of a length thereof.

13. The floating hydrocarbon processing and storage structure according to claim 11, wherein the central deck supports the one or more of the plurality of risers and the pipe elements horizontally supported on the central deck along half of a length thereof.

14. The floating hydrocarbon processing and storage structure according to claim 1, wherein the mooring system comprises a turret carrying the at least one hydrocarbon riser, and connected to mooring lines that are moored to the sea bed, and the connection structure comprises a bow deck structure rotatably connected to the turret and connected to the hull deck structures and to the central deck at or near the height of said hull deck structures.

15. The floating hydrocarbon processing and storage structure according to claim 14, wherein the bow deck structure is connected to the hull deck structures along the combined width of the first and second hulls and the central deck.

16. The floating hydrocarbon processing and storage structure according to claim 15, wherein the bow deck structure is connected to the hull deck structures along the combined width of the first and second hulls and the central deck.

17. The floating hydrocarbon processing and storage structure according to claim 14, further comprising a bow structure extending from the bow deck structure to below the water line, and interconnecting with the side walls of the hulls to form a substantially closed bow.

* * * * *